US009068771B2

(12) United States Patent
Shah

(10) Patent No.: US 9,068,771 B2
(45) Date of Patent: Jun. 30, 2015

(54) METHOD FOR AUTOMATICALLY ADJUSTING THE DEFROST INTERVAL IN A HEAT PUMP SYSTEM

(75) Inventor: Rajendra K. Shah, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 1666 days.

(21) Appl. No.: 11/646,228

(22) Filed: Dec. 27, 2006

(65) Prior Publication Data

US 2007/0180838 A1 Aug. 9, 2007

Related U.S. Application Data

(60) Provisional application No. 60/760,540, filed on Jan. 20, 2006.

(51) Int. Cl.

| | |
|---|---|
| ***F25D 21/02*** | (2006.01) |
| ***F25D 21/06*** | (2006.01) |
| ***G05D 23/32*** | (2006.01) |
| ***F25D 21/00*** | (2006.01) |

(52) U.S. Cl.
CPC ..... *F25D 21/008* (2013.01)

(58) Field of Classification Search
USPC ..... 62/157, 140, 150–156, 234
See application file for complete search history.

(56) References Cited

U.S. PATENT DOCUMENTS 5,440,893 A * 8/1995 Davis et al. ..... 62/155

FOREIGN PATENT DOCUMENTS

GB 0278701 * 8/1988 ..... 62/155

* cited by examiner

*Primary Examiner* — Travis Ruby
(74) *Attorney, Agent, or Firm* — Cantor Colburn LLP

(57) ABSTRACT

The present invention relates generally to a method for automatically adjusting the interval of time between defrost cycles in a heat pump system. The method includes tracking the duration of the previous defrost cycle or cycles, and dynamically adjusting the length of time before initiating the next defrost cycle.

17 Claims, 1 Drawing Sheet

Note: steps do not have to be performed in the order shown in flow chart

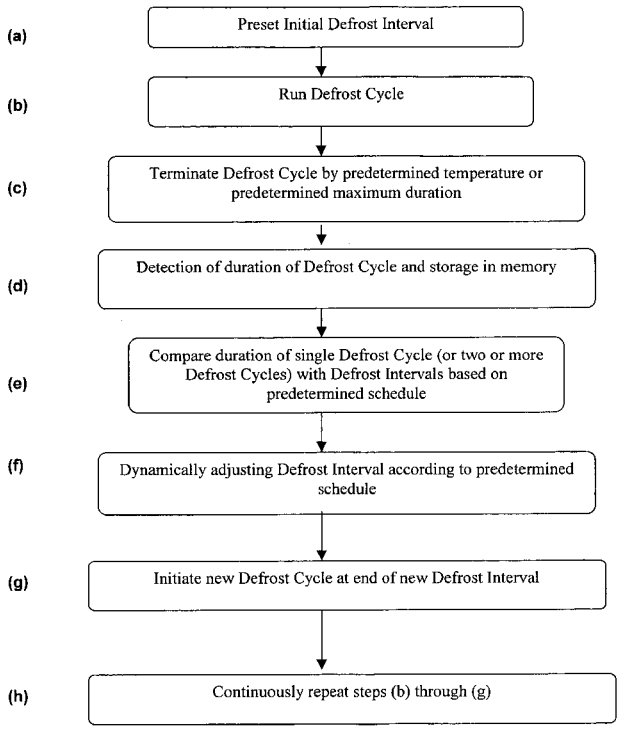

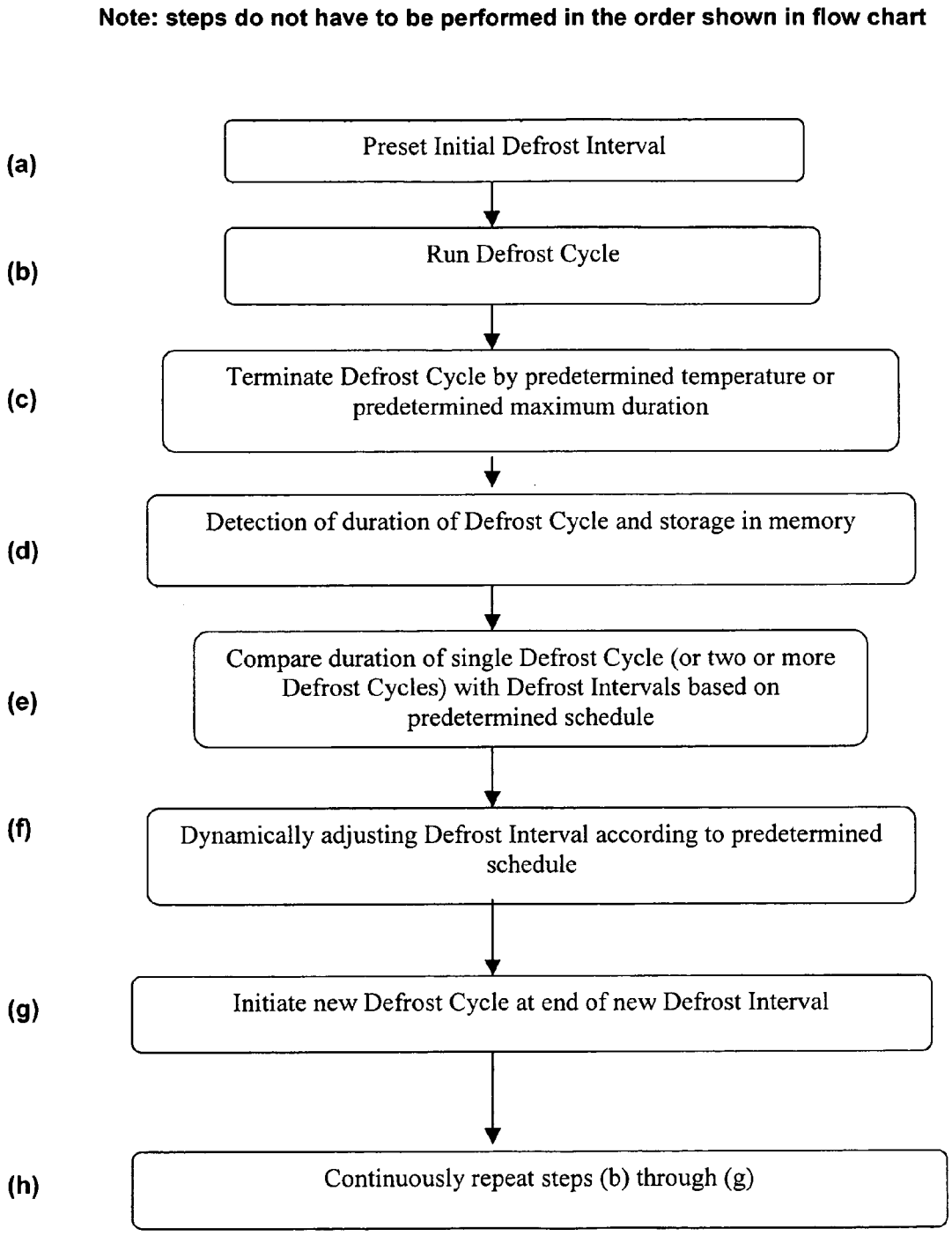
Note: steps do not have to be performed in the order shown in flow chart
(a)
Preset Initial Defrost Interval
(b)
Run Defrost Cycle
(c)
Terminate Defrost Cycle by predetermined temperature or predetermined maximum duration
(d)
Detection of duration of Defrost Cycle and storage in memory
(e)
Compare duration of single Defrost Cycle (or two or more Defrost Cycles) with Defrost Intervals based on predetermined schedule
(f)
Dynamically adjusting Defrost Interval according to predetermined schedule
(g)
Initiate new Defrost Cycle at end of new Defrost Interval
(h)
Continuously repeat steps (b) through (g)

METHOD FOR AUTOMATICALLY ADJUSTING THE DEFROST INTERVAL IN A HEAT PUMP SYSTEM

CROSS-REFERENCE TO A RELATED APPLICATION

The present application claims priority in U.S. Provisional Patent Application No. 60/760,540, filed Jan. 20, 2006, which is incorporated in its entirety by reference herein.

BACKGROUND OF THE INVENTION

1. Field of the Invention

The present invention relates generally to a method for automatically adjusting the interval of time between defrost cycles in a heat pump system. The method utilizes measurements of the duration of the previous defrost cycle or cycles, and adjusts the time interval before initiating the next defrost cycle so that any frost build-up can be defrosted without unnecessary defrost cycles.

2. Description of the Related Art

Heat pump systems generally build frost on the outdoor heat exchanger coil when operating in the heating mode. This frost build-up can gradually degrade the heat exchanger and system performance in the form of heating capacity and efficiency. If the frost is not cleared, it can continue to build-up until the heat exchanger coil becomes completely blocked with ice. At this point, in most heat pump systems, protective devices typically cause the system to shut down. If the protective devices are not effective, equipment failure could occur.

For these reasons, it is common practice in most heat pump systems to incorporate a way to defrost. For example, most heat pump systems operate in the cooling (air conditioning) mode for short periods of time, thereby reversing the flow of refrigerant in the system with the help of a reversing valve. Also, during this defrost cycle, the outdoor fan, which blows air over the outdoor heat exchanger coil, is stopped. When the heat pump operates in the cooling mode without the outdoor fan running, the outdoor heat exchanger coil heats up quickly, to melt the frost.

Defrosting in this manner has its penalties. Running the heat pump in cooling mode while the home needs heating capacity clearly leads to wasted energy. Furthermore, the cold air delivered inside the home can be quite uncomfortable in the heating season. To warm up the air to comfortable levels during a defrost cycle, most heat pump systems activate a supplemental heat source. Typically, this supplemental source is electric strip heat, which itself consumes a great amount of electric energy. Another problem is that two refrigerant flow reversals are needed in a defrost cycle, from heating to cooling and back to heating. The flow reversals are usually quite noisy, and are an annoyance to the consumer.

In order to minimize the negative impact of these defrost cycles on energy usage, noise levels, and consumer comfort, it is desirable to reduce the frequency and duration of defrost cycles. The ideal system should defrost just often enough to eliminate frost and no more. This can be quite challenging because the rate of frost build up varies with the weather. Outdoor temperatures, humidity and wind levels all play a role in determining how much frost accumulates on the coils. Different climatic areas have different weather patterns and, therefore, different defrost requirements.

Several defrost control strategies and algorithms have been employed in the prior art. Most defrost controls involve use of electronic circuits or microprocessors. The general approach is to estimate the presence of sufficient frost to initiate a defrost cycle, and then determine a sufficient clearing of frost from the coils to terminate the defrost cycle.

The most common method of terminating defrost cycles involves sensing the temperature at an appropriate point in the heat exchanger coil. During a defrost cycle, the coil starts to heat up as the hot compressed refrigerant flows through it. However, the heat is first used to melt whatever amount of frost there is on the coil. Once all the frost is cleared, the heat starts to increase the temperature of the coil very quickly. A defrost control that has a coil temperature sensor can detect this increased temperature and terminate the defrost cycle. Alternately, a pressure sensor or pressure switch can be used. Some simple defrost controls have no sensors, and instead run all defrost cycles for a fixed duration.

Determining when to initiate a defrost cycle is more challenging. A number of methods are employed in the prior art. These methods generally fall into two categories: "demand" defrosts and "timed" defrosts. Demand defrosts attempt to estimate the actual frost level or rate of frost accumulation under any set of conditions and wait until this estimate indicates a "demand" for defrosting before initiating. Since there is no practical direct sensing of frost level, these demand defrost methods use surrogate sensors to provide an estimate of the frost level. One example is to use the difference between coil temperature and outdoor air temperature. In this method, when the coil temperature falls sufficiently below the outdoor air temperature, a defrost cycle is initiated. The applicable principle is that a relatively colder coil will accumulate more frost. Many other schemes with varying degrees of sophistication have been used. These methods are not completely foolproof. They may defrost too frequently or too infrequently. The consequences are either a "block of ice" on the coils or complaints by consumers about too many defrosts.

The alternative, a timed defrost method, is much simpler. The control simply has a fixed time interval between defrost cycles. Typically, this time interval is in terms of accumulated heating mode operating time, not just elapsed time. Also, the installer of the heat pump system can typically select this fixed time interval from several available choices such as: 30 minutes, 60 minutes, 90 minutes, and 120 minutes. Once selected, the fixed time interval is applied for the life of the product, unless changed again by a service technician. Typically the defrost interval is selected by installing technicians to suit, in their judgment, the climatic conditions in their area.

As mentioned above, these conditions can change dynamically with the weather. A fixed "timed" defrost interval cannot always match the current defrost needs. This can lead to the same problems as "demand" defrosts.

While both methods described above have been extensively used, there is a desire for improvement.

SUMMARY OF THE INVENTION

The present disclosure provides a method of defrost control that is simple and robust, and that dynamically adjusts to changing conditions to ensure problem-free operation of a heat pump system. The primary focus is to eliminate the formation of excessive amounts of frost, while still reducing the frequency of defrost cycles when operating under less severe conditions.

The present disclosure also provides that the timed defrost interval dynamically changes in response to changing frost conditions, rather than being fixed.

BRIEF DESCRIPTION OF THE DRAWINGS

FIG. 1 is a flow chart of the method of the present invention.

DETAILED DESCRIPTION OF THE INVENTION

The present disclosure provides a method to dynamically and automatically adjust the interval of time between defrost cycles in a heat pump system. The method involves tracking the time duration of the previous defrost cycle (or cycles) and then dynamically adjusting the length of time before the next defrost cycle is initiated.

During a defrost cycle, also called a defrost routine, the heat that flows into the heat exchanger coil is first consumed in melting the frost, if any, that has previously built up on the coil. Once the frost is cleared, the heat quickly increases the temperature of the coil. The defrost control, upon sensing this increased coil temperature, terminates the defrost cycle. The time duration of a defrost cycle, therefore, primarily depends on the amount of previously accumulated frost on the coil. Greater amounts of accumulated frost result in longer defrost cycles. For example, in typical residential heat pump systems, defrost cycles range between one minute and ten minutes in duration.

A key feature of the present disclosure is that the duration of the defrost cycle is a very good measure of the frosting conditions present at that time. A long defrost cycle indicates weather conditions that cause heavy frost accumulation. In such a situation, defrost cycles should occur more frequently to keep up with frost accumulation. On the other hand, a short defrost cycle indicates weather conditions that are not causing significant frost accumulation. This situation requires less frequent defrost cycles. The defrost cycle duration is a very simple but direct measure of frosting conditions, unlike previous demand defrost methods that rely on temperatures or pressures.

The present disclosure provides a method by which shorter defrost cycles are followed by longer time intervals until the next defrost cycle begins, and, conversely, a method by which longer defrost cycles is followed by shorter time intervals before the next defrost cycle begins.

In an embodiment of the present disclosure, initiation of a defrost cycle in a heat pump starts a flow of heat into the heat exchanger. Any frost that has previously accumulated on the coils, is melted by the heat. Once the frost is cleared, the heat quickly increases the temperature of the coil, until there is termination of the defrost cycle when either:

(a) the coil temperature exceeds 65 degrees Fahrenheit (° F.); or (b) the defrost cycle lasts for 10 minutes, which is the upper time limit.

The defrost control in this embodiment includes a microprocessor that is capable of keeping track of multiple time intervals. The microprocessor tracks the time duration of every defrost cycle, which is the time between the initiation of a defrost cycle and its termination. Based upon the duration of time of the most recent defrost cycle, the microprocessor initiates the next defrost cycle according to the following schedule:

| Duration of Defrost Cycle | Defrost Interval |
|---|---|
| Less than 3 minutes | 120 minutes |
| 3 to 5 minutes | 90 minutes |
| 5 to 7 minutes | 60 minutes |
| 7 to 10 minutes | 30 minutes |

As used in the schedules for this disclosure, Duration of Defrost Cycle means the length of time (duration) of the last defrost cycle from its initiation to termination. Defrost Interval means the amount (interval) of time between the end of the previous defrost cycle and the beginning of a new defrost cycle. The first time the system operates, that is before any defrost cycle has occurred, the defrost interval is usually set for 30 minutes, although this single time period can be selected by the manufacturer, installer, or operator of the heat pump system.

For example, using the schedule provided for in this embodiment of the present disclosure, if a given defrost cycle operated for a total duration of 4 minutes until it reached the termination temperature of 65° F., the microprocessor would schedule the next defrost cycle to initiate approximately 90 minutes after the end of the most recent defrost cycle. If the next defrost cycle required only 2 minutes to clear any accumulated frost and to heat the coils to the termination temperature of 65° F., the microprocessor would schedule the next defrost cycle to initiate approximately 120 minutes after the end of the latest defrost cycle. This dynamic relationship of regulating the interval between defrost cycles continues for the service life of the heat pump system. It should forestall the build-up of ice on the heat pump coils while minimizing the annoyance and energy use caused by defrost cycles that are too frequent.

The termination temperature used to signal the end of the defrost cycle in this embodiment of the present disclosure is 65° F., which is well above the freezing temperature (32° F.) of the ice that forms on the coils. However, a range of termination temperatures from about 45° F. to about 75° F. are acceptable. The termination temperature can be pre-set by the manufacturer or set by the heat pump system operator, depending on the design parameters of a particular heat pump system. Also, termination temperature can be changed in response to geographical and seasonal variations.

In a preferred embodiment of the present disclosure, the maximum time limit for a defrost cycle is 10 minutes. The 10 minute maximum time limit for the duration of the defrost cycle is based on experience with typical heat pump systems. However, this maximum time limit can be changed or even eliminated depending on the design parameters of a particular heat pump system. For instance, a design parameter that would influence the maximum defrost time could be placement of the heat pump unit inside of a climate-controlled residence, instead of outside of the residence in an unheated storage room.

Although the above embodiment of the present disclosure provides four distinct defrost intervals (30, 60, 90, or 120 minutes), additional intervals values could be added, either within the 30-120 minute range or outside of this range.

Another embodiment of the present disclosure that uses a different group of defrost intervals for the heat pump system could also be set to the following schedule:

| Duration of Defrost Cycle | Defrost Interval |
|---|---|
| Less than 1 minute | 140 minutes |
| 2 to 3 minutes | 110 minutes |
| 3 to 4 minutes | 95 minutes |
| 4 to 5 minutes | 80 minutes |
| 5 to 6 minutes | 70 minutes |
| 6 to 7 minutes | 45 minutes |
| 7 to 8 minutes | 35 minutes |
| 8 to 9 minutes | 30 minutes |
| 9 to 10 minutes | 25 minutes |
| 10 to 11 minutes (maximum defrost cycle time) | 20 minutes |

As illustrated by the embodiments of the present disclosure, the relationship between the Duration of Defrost Cycle and the Defrost Interval can be any mathematical relationship that follows the basic principle that the time of the Defrost Interval increases as the time of the Duration of Defrost Cycle decreases. That is, the mathematical relationship between the Duration of Defrost Cycle and Defrost Interval can be either a linear or non-linear function, as long as an inverse relationship between these two time periods is maintained.

The lower limit for a Defrost Interval can be less than 30-minutes, as illustrated above. Of course, the heat pump system cannot defrost continually, or the heat pump could not accomplish its purpose of maintaining a comfortable temperature in the living space. The likely lower limit of time between defrost cycles is probably about 15 minutes, which would only be necessary in those conditions most conducive to frost formation, namely extreme cold and high air moisture content.

The present disclosure provides no upper time limit on the interval between defrost cycles. Warm temperatures and low moisture content (dry) outdoor air are not conducive to frost formation, and the interval between defrost cycles can probably be programmed to extend beyond 140 minutes in certain climates and seasons without substantially increasing the risk of frost accumulation on the heat pump coils.

A preferred embodiment of the present disclosure schedules the Defrost Interval based on a single data point; i.e., the most recent Defrost Duration. Scheduling the Defrost Interval based only on the most recent data point has the advantage of being most responsive to current conditions, such as weather, temperature, humidity, as well as the condition of the heat pump system, such as frost accumulation on the coils.

However, the present disclosure contemplates an embodiment where the microprocessor or other control device determines a schedule of Defrost Intervals where each interval is based on two or more previous Defrost Duration times, which are then averaged, or otherwise trended. This embodiment is somewhat less responsive to current conditions than the preferred embodiment described above, but offers the advantage of more predictable Defrost Intervals. Microprocessors for heat pump systems are capable of averaging and trending data for this embodiment if programmed to do so.

A control device as used in the present invention is a timer that monitors the Defrost Duration, and establishes the Defrost Interval, and automatically initiates the next defrost cycle based on a schedule such as those described above. The control device may be electrical or mechanical, or a combination of the two. The preferred embodiment uses a microprocessor as the control device that monitors the Defrost Duration, establishes the Defrost Interval, and then automatically initiates the next defrost cycle based on a schedule such as those described above. Another embodiment of the present disclosure could use a digital circuit timer with logical elements instead of, or in addition to, a microprocessor.

An embodiment of the present disclosure provides a method to dynamically adjust a defrost interval in a heat pump system based on a duration of a prior defrost routine by detecting the duration of a prior defrost routine, comparing the duration of a prior defrost routine with a schedule of defrost routines and defrost intervals, and dynamically adjusting the defrost interval based on a schedule of defrost routines and defrost intervals, wherein the numerical values for the duration of the defrost routines and the defrost intervals are inversely related. The inverse function relating the duration of the defrost routines and the defrost intervals may be a linear or a non-linear function.

The method may further comprise a step in which the method is repeated on a continuous basis unless deactivated by the heat systems operator or user/consumer.

The method may use an electronic processor to compare the duration of the prior defrost routine with the schedule of defrost routines and defrost intervals.

The initial defrost interval of this method may be preset. The duration at which the initial defrost interval is preset may be determined by the manufacturer, the heat system installer or operator, or by the consumer/user.

The defrost routine used in an embodiment of the method may be set to terminate operation when the condenser coils reach a temperature of about 45° F. to about 75° F., and preferably a temperature of about 65° F. The temperature at which the defrost routine is terminated is preset by the manufacturer and can be changed by the heat pump system operator in response to geographical and seasonal variations.

The embodiment provides a method for dynamically adjusting the defrost interval based only on the duration of the most recent prior defrost routine, or by averaging the duration of two or more prior defrost routines. The dynamic quality of the method is most sensitive to changes in temperature and frost when the method uses only the duration of the most recent prior defrost routine.

Another embodiment of the present disclosure provides a heat pump system comprising condenser coils and a control device. The control device is a timer that monitors the duration of a defrost routine, establishes the defrost interval, and automatically initiates the next defrost cycle. The control device is electrical (such as a microprocessor or digital circuit timer with logical elements), or mechanical, or a combination thereof.

While the present disclosure has been described with one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

The invention claimed is:

1. A method for dynamically adjusting a defrost interval in a heat pump system, the method comprising:

(a) initiating a defrost cycle;

(b) terminating the defrost cycle when a condenser coil reaches a threshold temperature or when a maximum duration time limit is reached;

(c) detecting the duration of the defrost cycle;

(d) dynamically adjusting the duration of the defrost interval as a function of the duration of the defrost cycle and a schedule of defrost cycles and defrost intervals, such that the duration of the defrost interval is inversely related to the duration of the defrost cycle;

(e) automatically initiating a next defrost cycle based solely upon completion of the duration of the defrost interval; and (f) repeating steps (b)-(e).

2. The method according to claim 1, further comprising repeating steps (b)-(e) of the method on a continuous basis unless deactivated by a user.

3. The method according to claim 1, wherein the step of adjusting the duration of the defrost interval as a function of the duration of the defrost cycle and a schedule of defrost cycles and defrost intervals is performed by an electronic processor.

4. The method according to claim 1, further comprising presetting an initial defrost interval.

5. The method according to claim 1, wherein the defrost cycle is terminated when condenser coils reach a temperature of about 45° F. to about 75° F.

6. The method according to claim 5, wherein the defrost cycle is terminated when the condenser coils reach a temperature of about 65° F.

7. The method according to claim 5, wherein the temperature at which the defrost cycle is terminated is preset by the manufacturer and can be changed by a heat pump system operator in response to geographical and seasonal variations.

8. The method according to claim 1, wherein the defrost cycle has a maximum duration of about 10 minutes.

9. The method according to claim 1, wherein the inversely related duration of the defrost cycle and duration of the defrost interval is a linear function.

10. The method according to claim 1, wherein the inversely related duration of the defrost cycle and duration of the defrost interval is a non-linear function.

11. The method according to claim 1, wherein the defrost interval is adjusted based on the duration of a most recent prior defrost cycle and a schedule of defrost cycles and defrost intervals.

12. The method according to claim 1, wherein the defrost interval is adjusted based on an average duration of at least two prior defrost cycles and a schedule of defrost cycles and defrost intervals.

13. A method for dynamically adjusting the defrost interval in a heat pump system based on a duration of at least one prior defrost cycle, the method comprising:

(a) presetting an initial defrost interval;
(b) running an initial defrost cycle;
(c) terminating the defrost cycle by a predetermined temperature or predetermined maximum duration;
(d) detecting the duration of the defrost cycle;
(e) dynamically adjusting the duration of the defrost interval as a function of the duration of the defrost cycle and a schedule of defrost cycles and defrost intervals;
(f) automatically initiating a next defrost cycle based solely upon completion of the duration of the defrost interval; and
(g) repeating steps (c)-(f).

14. A heat pump system comprising:
condenser coils; and
a control device,
wherein the control device is a timer that monitors a duration of a defrost cycle, establishes a defrost interval as a function of the duration of the defrost cycle and a schedule of defrost cycles and defrost intervals, automatically initiates a next defrost cycle upon completion of the defrost interval, and continuously repeats the steps of monitoring the duration of the defrost cycle, establishing a defrost interval as a function of the duration of the defrost cycle and a schedule of defrost cycles and defrost intervals, and automatically initiating a next defrost cycle based solely upon completion of the defrost interval.

15. The heat pump system according to claim 14, wherein the control device is electrical or mechanical, or a combination thereof.

16. The heat pump system according to claim 14, wherein the control device is a microprocessor.

17. The heat pump system according to claim 14, wherein the control device is a digital circuit timer with logical elements.

* * * * *